US009955844B2

(12) United States Patent
Fletty et al.

(10) Patent No.: US 9,955,844 B2
(45) Date of Patent: May 1, 2018

(54) METHODS OF OPERATING DISHWASHER WITH ILLUMINABLE USER INTERFACE

(71) Applicant: Whirlpool Corporation, Benton Harbor, MI (US)

(72) Inventors: Joel Fletty, Benton Harbor, MI (US); Eric A. Hill, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 73 days.

(21) Appl. No.: 15/065,194

(22) Filed: Mar. 9, 2016

(65) Prior Publication Data

US 2017/0258290 A1 Sep. 14, 2017

(51) Int. Cl.

| | |
|---|---|
| ***A47L 15/00*** | (2006.01) |
| ***H05B 37/02*** | (2006.01) |
| ***A47L 15/42*** | (2006.01) |
| ***A47L 15/50*** | (2006.01) |
| ***A47L 15/22*** | (2006.01) |

(52) U.S. Cl.

CPC ..... *A47L 15/0018* (2013.01); *A47L 15/22* (2013.01); *A47L 15/4225* (2013.01); *A47L 15/4261* (2013.01); *A47L 15/4285* (2013.01); *A47L 15/4287* (2013.01); *A47L 15/4293* (2013.01); *A47L 15/4297* (2013.01); *A47L 15/502* (2013.01); *A47L 15/507* (2013.01); *H05B 37/029* (2013.01); *A47L 2301/04* (2013.01); *A47L 2501/36* (2013.01)

(58) Field of Classification Search

None

See application file for complete search history.

(56) References Cited

U.S. PATENT DOCUMENTS

| | | | |
|---|---|---|---|
| 7,766,525 B2 | 8/2010 | Rosenbauer et al. | |
| 7,928,857 B2 | 4/2011 | Olesen et al. | |
| 2014/0048139 A1* | 2/2014 | Fisher | A47L 15/4297 137/2 |

* cited by examiner

*Primary Examiner* — Eric W Golightly

(74) *Attorney, Agent, or Firm* — McGarry Bair PC

(57) ABSTRACT

A method of operating a dish treating appliance includes a user interface disposed along the top edge of a door for selectively opening and closing access to a treating chamber. The user interface can be illuminated and operating the user interface can include operating a user input mode when the door is open and a status mode when the door is closed.

11 Claims, 7 Drawing Sheets

METHODS OF OPERATING DISHWASHER WITH ILLUMINABLE USER INTERFACE

BACKGROUND

Automatic dishwashers include a user interface. Typically at least a portion of the user interface is on the front of the dishwasher or on the front of the door. The user interface can include buttons, knobs, or touch elements to implement cycles of operation of the dishwasher. Typically, a status of the cycle of operation is identified by a timer illustrating time remaining or the position of a dial moving through the stages of the cycle of operation. Additionally, cycle options available to a user are listed as buttons on the user interface without communicating to a user which options are available to a particular cycle of operation.

SUMMARY

In one aspect, the invention relates to a method of operating a dish treating appliance having an illuminable user interface along a top edge of a closure, movable between opened and closed conditions. The method includes operating the illuminable user interface in a user input mode when the door is open and operating the illuminable user interface in a status mode when the door is closed.

In another aspect, the invention relates to a method of operating a dish treating appliance having a user interface with an array of inputs for cycles and cycles option. The user interface can have a corresponding light array for at least some of the inputs. The method can include controlling the activation of the array of lights to generate an animation indicative of a status of the dish treating appliance.

DESCRIPTION OF EMBODIMENTS OF THE INVENTION

Figure 1:
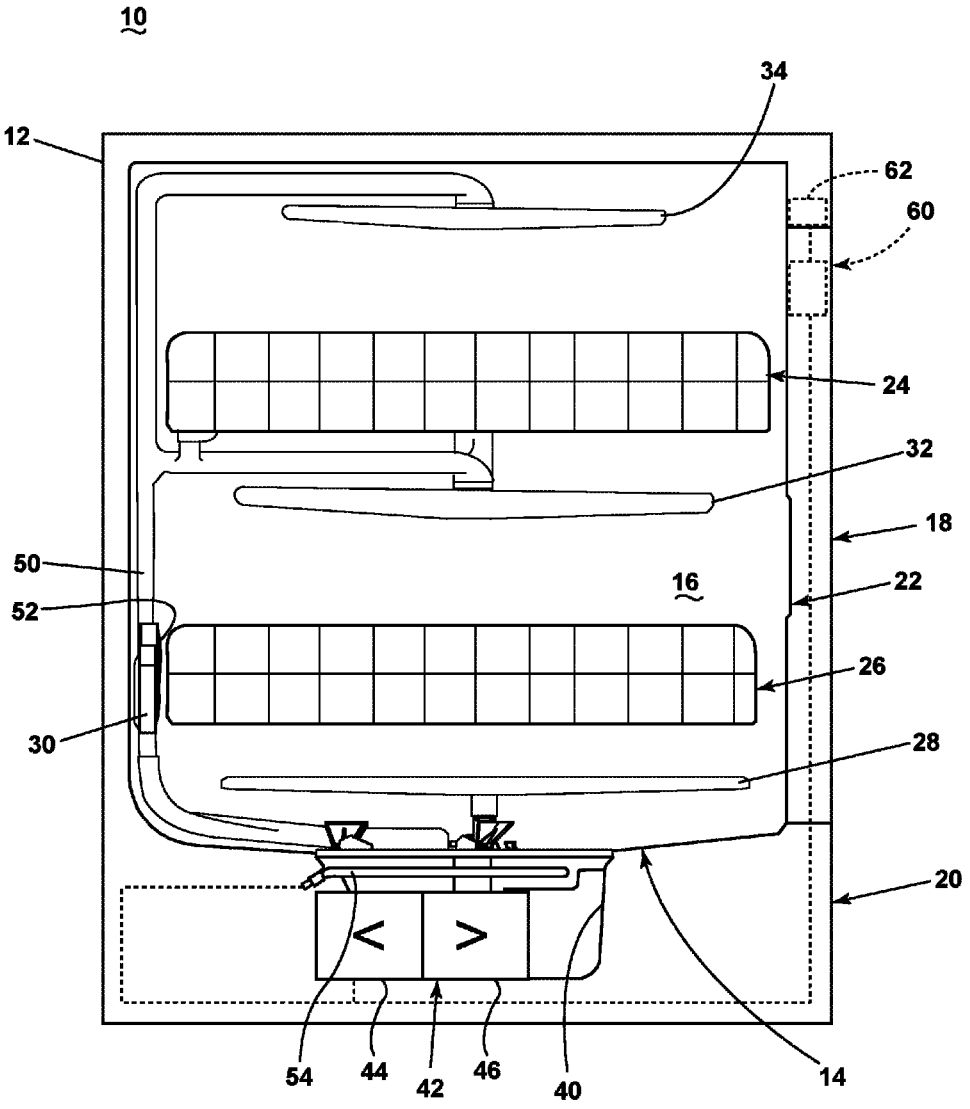
FIG. 1 is a schematic side cross-sectional view of a dishwasher.

In FIG. 1, a dish treating appliance illustrated as an automated dishwasher 10 includes a chassis 12 to define an interior of the dishwasher 10 and can include a frame, with or without panels mounted to the frame. A tub 14 can be provided within the chassis 12 and can at least partially define a treating chamber 16, having an open face, for washing dishes. A closure such as a cover or a door assembly 18 can be movably mounted to the dishwasher 10 for movement between opened and closed conditions to define an access opening 22, the door assembly 18 selectively opening and closing the access opening 22. Thus, the door assembly 18 provides accessibility to the treating chamber 16 through the access opening 22 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

The chassis 12 can further include a bottom panel 20 disposed beneath the pivot point of the door assembly 18. The door assembly 18 is shown in an exemplary closed position, but can be selectably opened to provide access to the treating chamber through an access opening 15.

Dish holders, illustrated in the form of upper and lower dish racks 24, 26, are located within the treating chamber 16 and receive dishes for washing. The upper and lower racks 24, 26 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 28, a second lower spray assembly 30, a rotating mid-level spray arm assembly 32, and/or an upper spray arm assembly 34. Upper sprayer 34, mid-level rotatable sprayer assembly 32 and lower rotatable sprayer assembly 28 are located, respectively, above the upper rack 24, beneath the upper rack 24, and beneath the lower rack 26 and are illustrated as rotating spray arms. The second lower spray assembly 30 is illustrated as being located adjacent the lower dish rack 26 toward the rear of the treating chamber 16. The second lower spray assembly 30 is illustrated as including a vertically oriented distribution header or spray manifold 52. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 40 and a pump assembly 42. The sump 40 collects the liquid sprayed in the treating chamber 16 and can be formed by a sloped or recessed portion of a bottom wall of the tub 14. The pump assembly 42 can include both a drain pump 44 and a recirculation pump 46. The drain pump 44 can draw liquid from the sump 40 and pump the liquid out of the dishwasher 10 to a household drain line (not shown). The recirculation pump 46 can draw liquid from the sump 40 and the liquid can be simultaneously or selectively pumped through a supply tube 50 to each of the assemblies 24, 26, 28, 30 for selective spraying. While not shown, a liquid supply system can include a water supply conduit coupled with a household water supply for supplying water to the treating chamber 16. A heating system including a heater 54 can be located within the sump 40 for heating the liquid contained in the sump 40 or heating the dishwasher during a drying cycle, for example.

A controller 60 can also be included in the dishwasher 10, which can be operably coupled with various components of the dishwasher 10 to implement a cycle of operation. The controller 60 can be located within the door 18 as illustrated, or it can alternatively be located somewhere within the chassis 12. The controller 60 can also be operably coupled with a control panel or user interface 62 for receiving user-selected inputs and communicating information to the user. The user interface 62 can include operational controls such as dials, lights, switches, and displays enabling a user to input commands, such as a cycle of operation, to the controller 60 and receive information.

Figure 2:
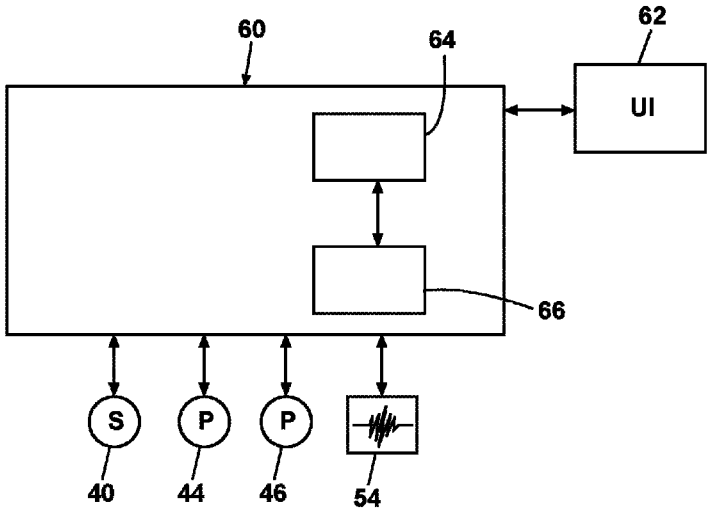
FIG. 2 is a schematic view of a controller of the dishwasher of FIG. 1.

As illustrated schematically in FIG. 2, the controller 60 can be coupled with the heater 54 for heating the wash liquid during a cycle of operation, the drain pump 44 for draining liquid from the treating chamber 16, and the recirculation pump 46 for recirculating the wash liquid during the cycle of operation. The controller 60 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. The controller 60 can also receive input from one or more sensors (not shown). Non-limiting examples of sensors that can be communicably coupled with the controller 60 include a temperature sensor and turbidity sensor to determine the soil load associated with a selected grouping of dishes, such as the dishes associated with a particular area of the treating chamber.

Figure 3:
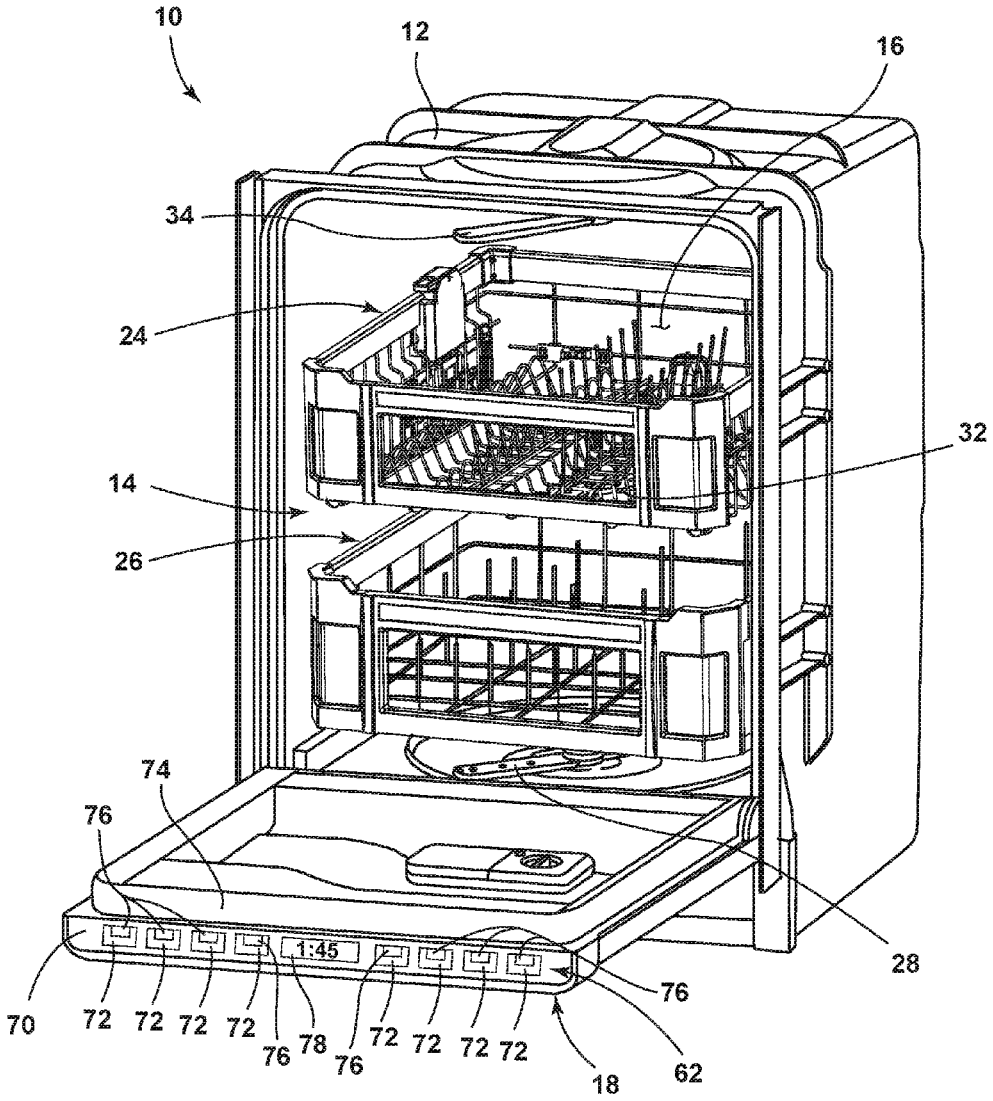
FIG. 3 is a perspective view of the dishwasher of FIG. 1 with an opened door illustrating a user interface on a top surface of the door.

Turning now to FIG. 3, a front view of the dishwasher 10 with the door 18 opened illustrates a top edge 70 of the door 18 and an inner seal 74 disposed on the inside of the door 18 for sealing the treating chamber 16 upon closing of the door 18. The top edge 70 includes the user interface 62, which includes a plurality of displays or buttons 72. The buttons 72 as shown are exemplary and can include touch buttons, icons, cycle options, start or stop conditions, times, or otherwise in non-limiting examples. There can be more or less buttons 72 as shown, and can be positioned in any manner, grouping, or arrangement on the top edge 70 to define the user interface 62. Each button 72 can have one or more illuminable portions 76 for illuminating the button 72 on the user interface 62. A number display 78 can display numeric values representative of times such as cycle completion times or cycle start times.

Figure 4A:
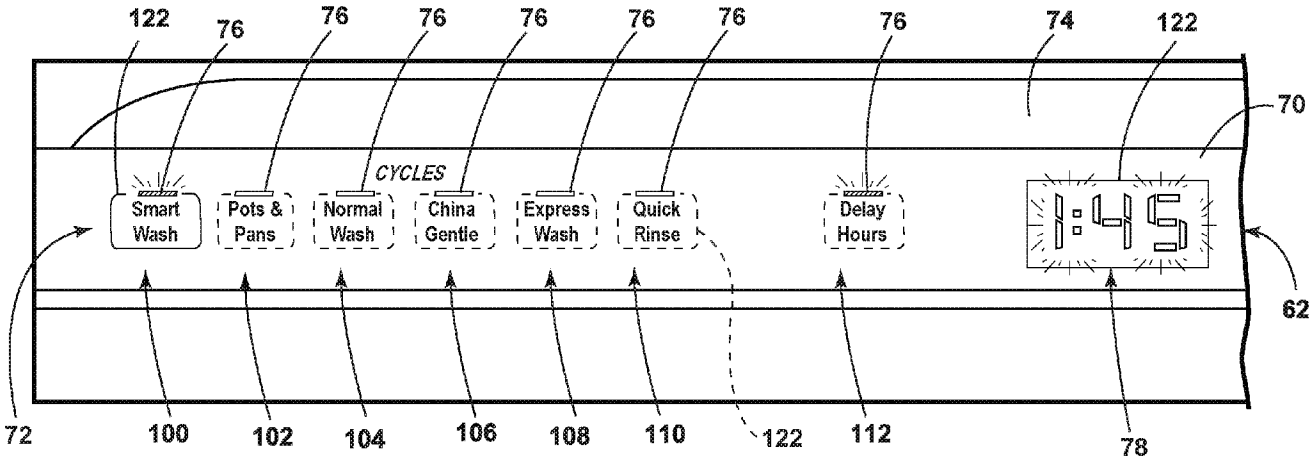
FIG. 4A is a top view of the left-hand side of the door of FIG. 3 having a user interface with different selectable cycles of operation.
Figure 4B:
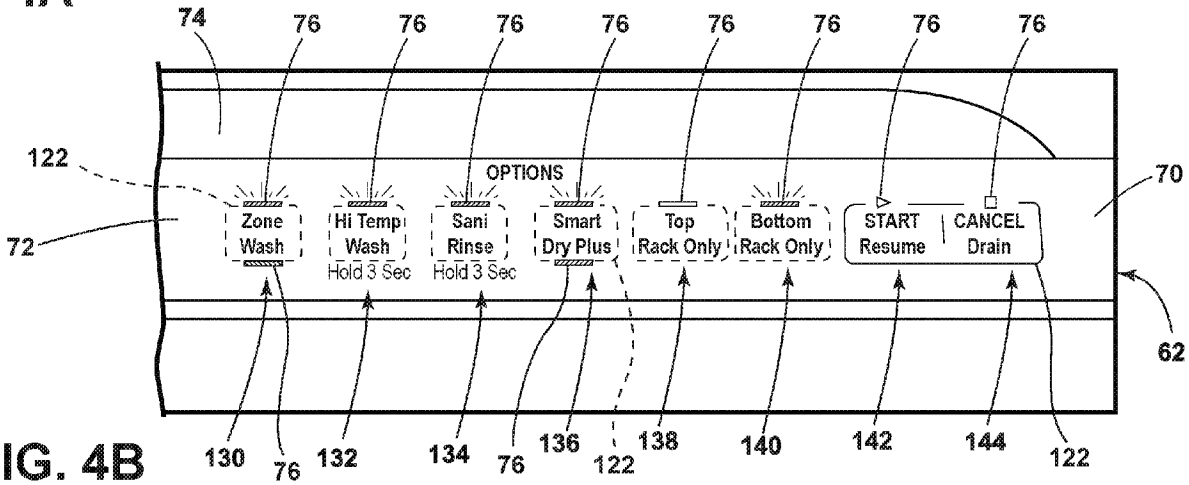
FIG. 4B is a top view of the right-hand side of the door of FIG. 3 having the user interface with different selectable options.

Looking at FIGS. 4A and 4B, two sides of an exemplary user interface 62 are illustrated disposed on the top edge 70 of the door 18. Looking at FIG. 4A, the plurality of buttons 72 can include a variety of user-selectable cycles of operation for the dishwasher 10 including smart wash 100, pots and pans 102, normal wash 104, china gentle 106, express wash 108, or quick rinse 110, referred to hereinafter collectively as a cycle of operation selectors or "cycle inputs." The cycles of operation can be defined by particular parameters represented by each cycle input. For example, the smart wash cycle input 100 can include parameters based upon determinations made by the controller 60 respective of the dishwasher 10 and articles therein. Additionally, the buttons 72 can include a delay button 112 for delaying the start of the selected cycle of operation. Furthermore, a time display 114 can illustrate the time until completion of the selected. Alternatively, the time display 114 can illustrate the time until the start of the selected cycle of operation and act as a visual representation of operation of the delay button 112. Each of the cycle inputs, as well as the delay button 112 and the time display 114 can include an illuminable portion. By way of non-limiting example, the illuminable portion is illustrated as a light 76 and an illuminable outline 122. The light 76 can include, but is not limited to, a LED disposed behind the surface of the user interface 62. The illuminable outline 122 can be a transparent or semi-transparent area of the surface of the user interface 62 through which light can escape from behind the user interface 62. Upon selection of a button 72 by the user, the light 76 can be illuminated by the controller 60, indicating that the button 72 has been selected. Additionally, at selection of the button 72, a light behind the illuminable outline 122 can be lit, lighting the illuminable outline 122. For example, as shown in FIG. 4A the smart wash button 100 has been selected, having the button illuminated at the adjacent light 76 and at the illuminated outline 122. Upon selection of the smart wash button 100, the delay hours button 112 and the time display 78 are illuminated relating to the operation of smart wash 100.

Looking at FIG. 4B, the user interface 62 includes additional buttons 72 including a zone wash 130, hi-temp wash 132, sani-rinse 134, smart dry plus 136, top rack only 138, and bottom rack only 140, referred to hereinafter collectively as "cycle option inputs." Additionally, the user interface 62 includes a start button 142 and a cancel button 144. Each cycle option input as well as the start button 142 and the cancel button 144 can also include at least one adjacent light 76. The turbo zone 130 and smart dry plus 136 buttons have two lights 76, disposed above and below the buttons 72.

It should be understood that each button 72 can have one or more lights 76, and the illuminable portions are not limited to the positions and implementations as shown. The use of additional or multiple buttons can indicate parameters specific to the cycle of operation. For example, a light 76 above and below an option input can relate to a top and bottom rack within the treating chamber 16. Instead, the buttons 72 merely need to have an illuminable portion that has the ability for illumination. Further, any illuminable portions including the lights 76 can include different shapes or constructions. For example, the lights 76 adjacent to the start button 142 and the cancel button 144 can be a triangle and a square, respectively, commonly associated with start and stop functions.

It should be appreciated that the lights 76 and the illuminable outlines 122 along the user interface 62 can include a light array, where the light array is a plurality of lights disposed in an organized or designed manner. Additionally, the lights 76 and illuminable outlines 122 can be different colors, such as a grouping of different color LEDs selectively operable to illustrate multiple colors. The lights 76 and illuminable outlines 122 can have different brightness, having greater or lesser brightness based upon particular parameters of the cycle of operation or interaction with the user interface 62. Further still, it will be understood that any combination of the adjacent light 76 and the illuminable outline 122 can be illuminated to indicate selection by a user or that such button is user selectable. A combination of illuminated adjacent lights 76 and illuminated illuminable outlines 122 has been illustrated and is merely exemplary.

Figure 5:
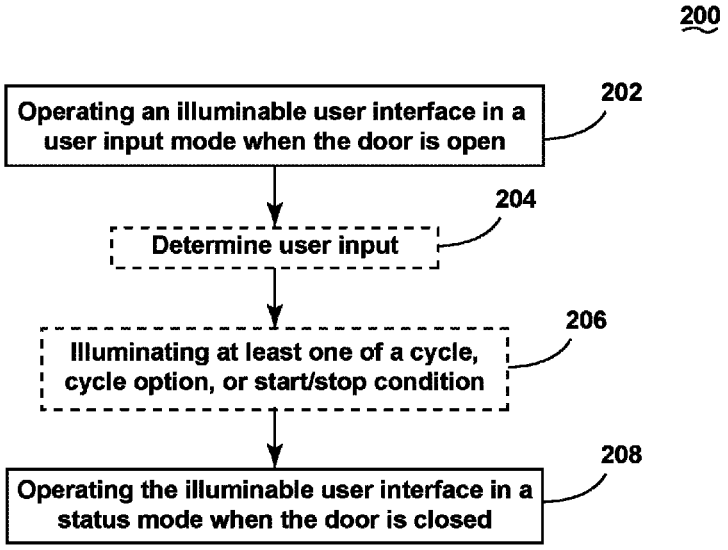
FIG. 5 is a flow chart illustrating a method of operating the dishwasher of FIG. 1.

Looking at FIG. 5, a method 200 of operating the dishwasher 10 can include operating the user interface 62 to illuminate various illuminable portions. At 202, the door 18 can be opened and the user interface 62 can be operated in a user input mode. During the user input mode, the user interface 62 can be selectively illuminable during operation or interaction with the buttons 72 by a user. During the user input mode, the controller 60 can detect that the door 18 is open, providing user access to the user interface 62 and the top edge 70. Upon opening of the door 18, a signal is sent to the controller 60 that the door 18 is opened and the controller 60 can illuminate one or more of the lights 76 of the illuminable outlines 122. Alternatively, the controller 60 can detect a user input where the user has interacted with the user interface 62 to begin the user input mode. User input can include a user pushing, touching, selecting, or otherwise activating one or more of the buttons 72 on the user interface 62. At interaction, the controller 60 sends a signal to the controller 60 that the user input mode has begun and can illuminate one or more lights 76 or illuminable outlines 122.

At 204, the controller 60 can optionally determine user input. The user input can determine a selected cycle of operation or one or more selected parameters associated with the selected cycle of operation. Optionally, at 206, the controller 60 can illuminate at least one of a selected cycle inputs, selected option inputs, or selected start/stop condition. Said illumination can be in response to selectable options available to the user upon initiation of the user input mode, or additional available options based upon selection of one or more of the cycle inputs, option inputs, or start/stop conditions. The user input mode can further include controlling the illumination of the lights 76 and the illuminated outline 122 based upon user selections of buttons 72 at the user interface 62. During the illuminating one of a cycle, cycle option, or start/stop condition 206, the method 200 can further include illuminating at least one of a use-available input, which can include one or more of the cycle inputs, cycle option inputs, delay button 112, start button 142, or cancel button 144. The use-available inputs can be illuminated based upon standard wash cycles or common wash cycle options typical to use for the dishwasher 10 upon opening of the door 18 or typical to use of a particular cycle input upon selection.

For example, as illustrated in FIGS. 4A and 4B, the smart wash button 100 is illuminated. Illumination of the light 76 and illuminable outline 122 of the smart wash button 100 can occur upon opening of the door 18 as a use-available input, or upon selection by a user as a user-selected input. Upon illumination of the light 76 and illuminable outline 122 of the smart wash button 100, the lights 76 and illuminable outlines 122 of additional use-available buttons can be illuminated. As shown, the delay 112, zone wash 130, hi-temp wash 132, sani-rinse 134, smart dry plus 136, and bottom rack only 140 lights 76 are also illuminated. These are all use-available buttons 72 available under the smart wash cycle 100. The illumination of the use-available button lights 76 informs the user of which options related to the smart wash cycle 100 are available for tailoring the cycle to the user's needs. These options can also be pre-selected and act as inputs to the controller 60 for utilization in the smart wash cycle of operation. A user may deselect these pre-selections and the light 76 or illuminable outline 122 would no longer be illuminated.

Still referring to FIG. 5, at 208, the user interface 62 can operated in a status mode when the door 18 is closed. The status mode can be a mode of operation for the user interface 62 by the controller 60 where the operation of the user interface 62 can be indicative of the status of the dishwasher 10 or the cycle of operation being implemented. The status mode can include controlling the illumination of the lights 76 or illuminable outlines 122 to provide a predetermined animation. The animation can correspond to a cycle of operation being implemented or to a status condition, where a status condition gives status information related to an ongoing, pending, or finished cycle of operation. The animation can include a sweeping, random, or pulsing display or a combination thereof in non-limiting examples. A sweeping animation can include sequentially illuminating the lights 76 in a predetermined direction on the user interface 62. Furthermore, different animations can indicated different aspects of the cycle of operation. For example, the sweeping animation can indicate cycle progress, the random animation can indicate a rinse phase, and the pulsing animation can indicated completion of the cycle. The random animation can include randomly illuminating the lights 76 and the pulsing display can include a turning on/off, in unison, a series of lights 76 or increasing or decreasing of the brightness of the lights 76. The animation can further include changing the speed of illumination of the lights 76, the color of illumination, the intensity of the illumination, which can be determined by the brightness, as well as blinking, flashing or other light animations.

The animation can relate to the cycle of operation of the dishwasher 10. For example, the changing speed of the illumination or changing of the color can indicate an end of or change in a phase of the cycle, or any other parameter. For example, changing from a rinse cycle to a dry cycle can include a blinking or flashing animation informing the user of the cycle change. Additionally, the change in color can indicated a temperature within the dishwasher 10, which can be determined by a sensor disposed within the dishwasher 10. For example, during a high heat wash cycle, the color can be red, while a cold water cycle can be blue.

Figures 6A, 6B, 6C:
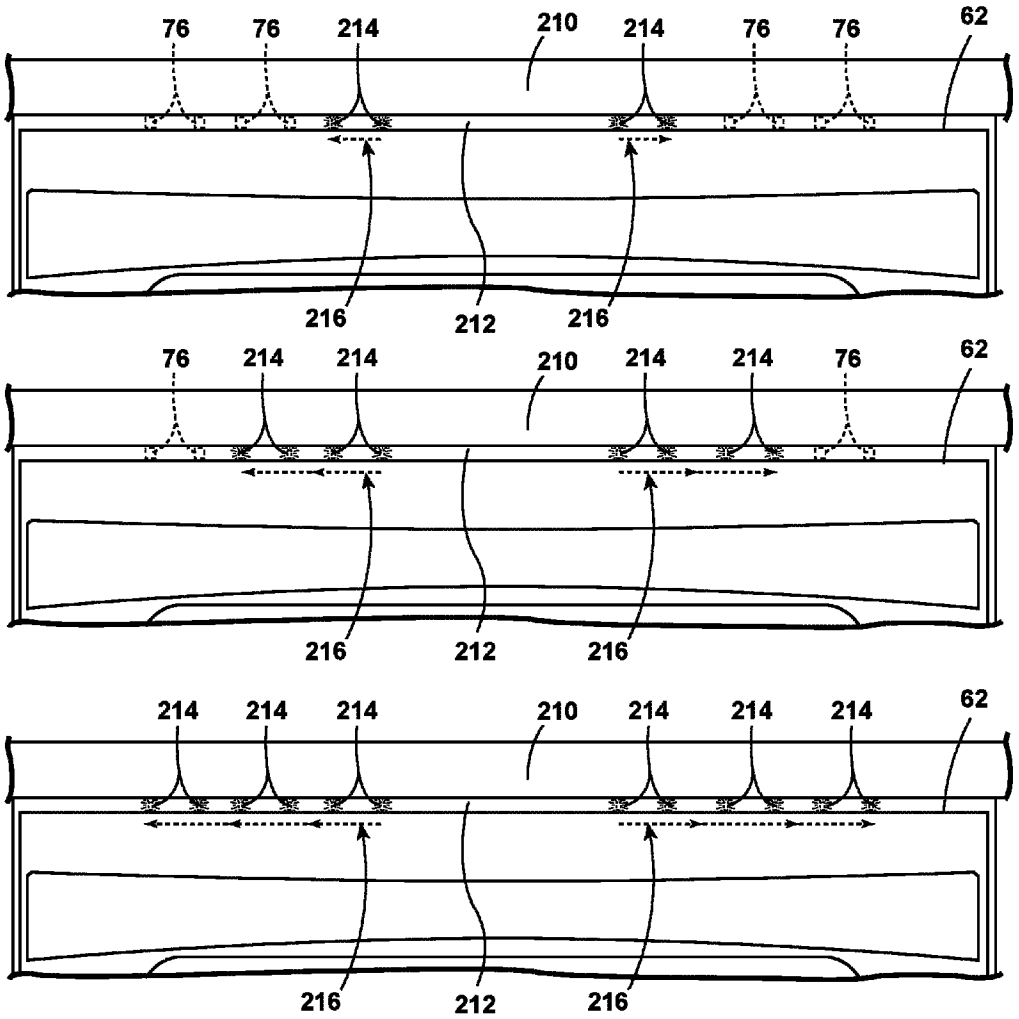
FIGS. 6A-6C are front views of the top of the door illustrating an illumination of the user interface when the door is closed.

Looking now at FIGS. 6A-6C, the door 18 is in a closed position and the user interface 62 is operating in the status mode illustrating a sweeping animation. The user interface 62 is disposed in a horizontal position, underneath an exemplary cabinet 210 providing a gap 212 between the top edge 70 and the bottom of the cabinet 210. Illumination of one or more of the lights 76, illustrates as illuminations 214, is visible to a user within the gap 212.

Looking at FIG. 6A, during an ongoing cycle of operation, two lights 76 are illuminated as illustrated by the illuminations 214 near the middle of the user interface 62. For example, the express wash 108 and quick rinse 110 buttons of FIG. 4A and the turbo zone 130 and hi-temp wash 132 buttons of FIG. 4B can be illuminated as illustrated by the illuminations 214. The lights 76 can be illuminated in an exemplary sequence to display an animation, such that the lights 76 disposed closer to the middle of the user interface 62 are illuminated first and the additional lights extending from the middle of the user interface 62 are illuminated in a timed sequence after the middle lights 76 to display a sweeping animation, illustrated by directional arrows 216. Looking at FIG. 6B, additional lights 76 can be illuminated over time extending toward the sides of the user interface 62 to illustrate the sweeping animation. Finally in FIG. 6C, all of the lights 76 can be illuminated as illumination 214 during the sequence. After illumination of all of the lights 76, the illuminations 214 toward the middle of the user interface 62 can begin to dim and eventually turn off, displaying a sweeping light sequence from the middle of the user interface 62 toward the outer edges. This can be an example of a status indicator that the cycle of operation is being implemented.

Figures 7A, 7B, 7C:
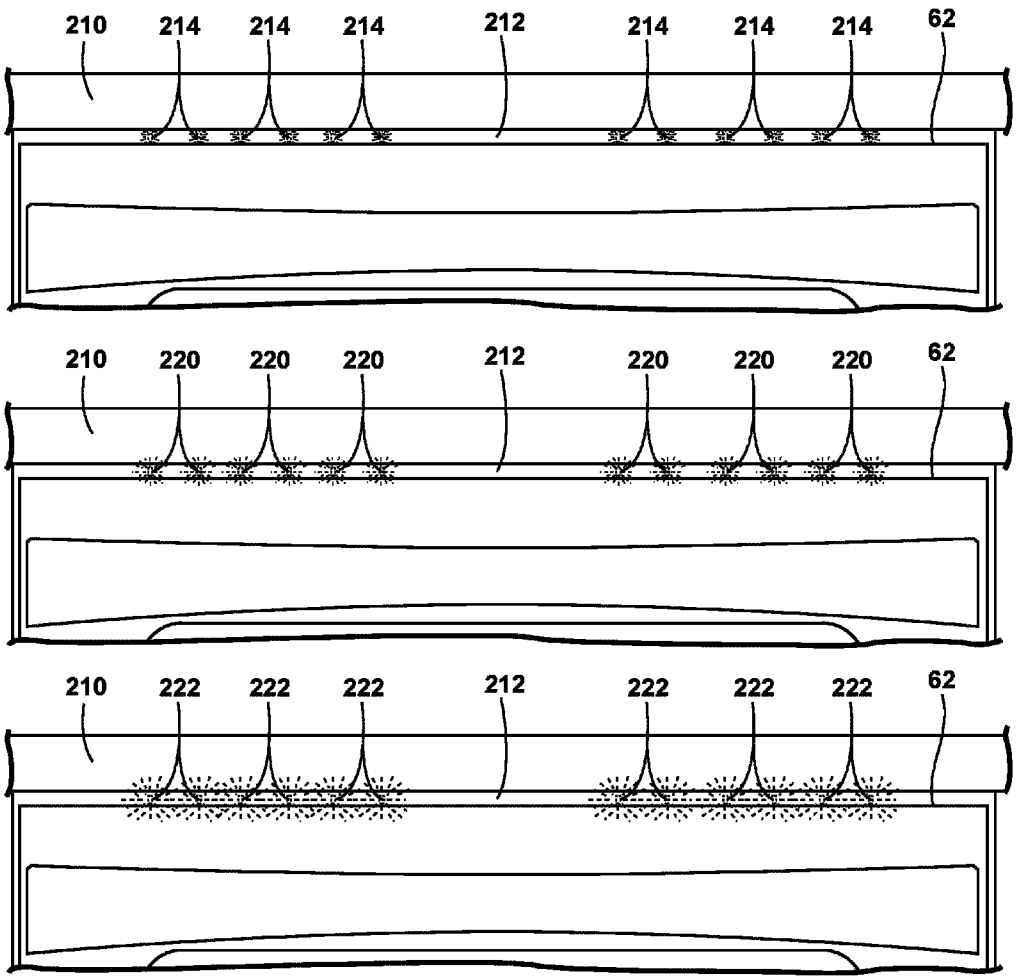
FIGS. 7A-7C are front views of the top of the door illustrating illuminations having increased brightness or changed colors.

Looking at FIGS. 7A-7C, additional illuminations 214 are illustrated as brighter illuminations 220 or colored illuminations 222. In FIG. 7A, all of the lights 76 are lit as illuminations 214, which is indicative of a status of the dishwasher 10, such as that the cycle of operation is finished. In FIG. 7B, the illuminations 220 can be brightened, having a greater intensity. The brightening of the illuminations 220 can be pulsing or blinking to indicate a status of the dishwasher, such as indicating a drying phase. In FIG. 7C, the color of the illuminations 222 can be changed to indicate a status of the dishwasher 10. For example, the color can change from a blue to a red illumination 222 indicating that the internal temperature of the dishwasher 10 has increased.

It should be understood that the status mode animations as described herein can be related to operational parameters of the selected and implemented cycle of operation of the dishwasher 10, and are not limited to the cycle of operation described. The animations can include any animation being patterned, sequenced, random or otherwise, or any combination thereof in non-limiting examples. The lights 76 can be of multiple colors or intensities. These aspects of the animations can be utilized in any combination of ways to represent a cycle of operation, a status thereof, or a parameter associated therewith, or a combination of the aforementioned.

It should be appreciated that the user interface is beneficial in providing the user a visual indication of the cycles, cycle options, or other selectable parameters available for use. Furthermore, the user interface can provide the user a visual indication of a status of the dishwasher or a cycle of operation associated with the operation of the dishwasher while hiding the user interface from immediate view.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a dish treating appliance, the method comprising:

operating an illuminable user interface, which is located along a top edge of a closure movable between an opened and closed condition, in a user input mode when the door closure is open including selectively illuminating at least one portion of the illuminable user interface; and operating the illuminable user interface in a status mode when the closure is closed controlling the illumination of the illuminable user interface to provide a predetermined animation for a corresponding status condition wherein the predetermined animation comprises at least one of sweeping to indicate progress, random to indicate a rinse phase, or pulsing to indicate completion.

2. The method of claim 1 wherein the user input mode comprises controlling illumination of the illuminable user interface based on user selections via the illuminable user interface.

3. The method of claim 2 wherein controlling illumination of the illuminable user interface comprises illuminating at least one of a user-selected: cycle, cycle option, or start/stop condition.

4. The method of claim 3 wherein controlling the illumination of the illuminable user interface comprises illuminating at least one of an available for use: cycle, cycle option, or start/stop condition.

5. The method of claim 1 wherein the closure is a door.

6. A method of operating a dish treating appliance, the method comprising:

operating an illuminable user interface, which is located along a top edge of a closure movable between an opened and closed condition, in a user input mode when the closure is open including selectively illuminating at least one portion of the illuminable user interface; and operating the illuminable user interface in a status mode when the closure is closed controlling the illumination of the illuminable user interface to provide a predetermined animation for a corresponding status condition;

wherein at least one of: a speed of the illumination is increased to indicate an end of a phase of a cycle or a color of the illumination is changed to indicate a change in a phase of a cycle.

7. The method of claim 6 wherein the predetermined animation comprises at least one of: sweeping, random, or pulsing.

8. The method of claim 7 wherein:

sweeping comprises sequentially illuminating in a predetermined direction a series of lights on the illuminable user interface;

random comprises randomly illuminating a series of lights on the illuminable user interface; and pulsing comprises turning on/off in unison a series of lights on the illuminable user interface.

9. The method of claim 7, further comprising an intensity of the illumination.

10. The method of claim 7 wherein the sweeping indicates progress, the random indicates a rinse phase, and the pulsing indicates completion.

11. The method of claim 6 wherein the color of the illumination indicates a temperature within the dish treating appliance.

* * * * *